United States Patent [19]

Lubowitz

[11] 4,003,771

[45] Jan. 18, 1977

[54] SOLID GRAIN FUELS CONTAINING POLYPHOSPHONITRILICS DIFLUORIDE FOR CHEMICAL LASERS

[75] Inventor: Hyman R. Lubowitz, Hawthorne, Calif.

[73] Assignee: TRW Inc., Redondo Beach, Calif.

[22] Filed: Aug. 7, 1975

[21] Appl. No.: 602,629

[52] U.S. Cl. ..... 149/17; 149/19.3; 149/20; 149/119

[51] Int. Cl.[2] ..... C06B 45/04

[58] Field of Search ..... 149/19.3, 17, 20, 119; 423/301

[56] References Cited

UNITED STATES PATENTS

| | | | |
|---|---|---|---|
| 2,980,495 | 4/1961 | Rätz et al. | 423/301 |
| 3,669,020 | 6/1972 | Waite et al. | 149/19.3 X |
| 3,703,359 | 11/1972 | Papetti | 149/17 |
| 3,732,132 | 5/1973 | Merrow et al. | 149/19.3 X |
| 3,752,703 | 8/1973 | Toy et al. | 149/19.1 |
| 3,753,811 | 8/1973 | Julian et al. | 149/20 X |
| 3,797,238 | 3/1974 | Iwanciow et al. | 149/19.3 X |
| 3,863,176 | 1/1975 | Martinez et al. | 331/94.5 P |

OTHER PUBLICATIONS

Shaw et al., *Chem. Rev.*, 62, 276 (1962).
Allcock, *Chem. Rev.*, 72, 349–355 (1972).
Allcock et al., *Inorg. Chem.*, 11, 1120–1123 (1972).

*Primary Examiner*—Edward A. Miller
*Attorney, Agent, or Firm*—John J. Connors; Alan D. Akers; Edwin A. Oser

[57] ABSTRACT

This invention relates to laser fuels and, more specifically, to solid fuels suitable for use in a chemical laser.

2 Claims, No Drawings

SOLID GRAIN FUELS CONTAINING POLYPHOSPHONITRILICS DIFLUORIDE FOR CHEMICAL LASERS

BACKGROUND OF THE INVENTION

In the operation of chemical lasers, particularly the combustion-driven type, a fuel is burned in a combustor portion of the laser to form free atoms. These free atoms are then forwarded along with the other combustor gases to a cavity portion of the laser where they are reacted with a cavity fuel to form a lasing species. Lasing action takes place in the cavity after which the decayed lasing species and remaining gases are then removed from the cavity.

Typically, in a combustion-driven chemical laser, an excess of atomic fluorine is produced in the combustor by burning a fuel, and the combustor products, including the atomic fluorine are forwarded at supersonic speed to the cavity. Hydrogen or deuterium fuel is introduced into the cavity and reacts with the atomic fluorine to form the lasing species HF* or DF*. Decay of the lasing species to ground level produces laser emission at 2.6$\mu$ to 2.9$\mu$ for HF and 3.6$\mu$ to 4.0$\mu$ for DF. Reactions in the combustor are as follows when employing a hydrogen-fluorine or a deuterium-fluorine fuel system:

$$H_2 + F_2 \text{ (excess)} \rightarrow HF + F^\circ$$

or $$D_2 + F_2 \text{ (excess)} \rightarrow DF + F^\circ$$

The combustor reaction takes place at pressures ranging from about 10-200 psi and temperatures of about 1400°–3000° K. The high temperatures ensure total fluorine dissociation into atomic (i.e., free) fluorine.

If $H_2$ is employed in the combustor to form HF and free fluorine, deuterium is employed as the cavity fuel and vice versa. The reaction in the laser cavity is as follows:

$$2F + D_2 \rightarrow 2DF^*$$

or $$2F + H_2 \rightarrow 2HF^*$$

where DF* and HF* are the lasing species.

Cavity pressures vary from about 1–20 torr and cavity temperatures from about 300°–900° K. The spent reactants must be removed from the cavity at supersonic speeds since the ground state species will quench the lasing reaction.

The storage of gaseous fluorine presents problems because it is highly toxic and extreme precaution must be taken therefore to ensure fluorine containers are leakproof. When in use, chemical lasers employing fluorine present an additional hazard due to leakage from valves, joints, etc.

Hence, it would be desirable to employ fluorine compounds for lasers in the form of solid grains which would be inert at room temperature. At relatively high temperatures, the grains would release fluorine, or compounds with utilizable fluorine, to the laser. At the same time, the generation of fluorine must not release byproducts which will clog, damage or react with the laser components. In particular, feed nozzles from the combustor to the cavity and optical components are the two most vulnerable areas. Finally, the solid grains must be relatively inexpensive, and easy to prepare and handle.

According to the invention, there is provided a solid grain composition which can produce chlorine or fluorine containing compounds for use in a chemical laser comprising:

a. An oxidizing salt containing fluorine; typical salts include: $NF_4BF_4$, $NF_4SbF_6$, $N_2F_5AsF_6$, $N_2F_4AsF_5$, $NF_4AsF_6$, $NF_3HBF_4$, $NF_3HClF_3$, $N_2F_4HBF_4$, $N_2F_5BF_4$, $SF_5NF_2$, $KClF_4$, $SF_3BF_4$, $CsSF_5$, $KBrF_4$, $Ba(BrF_4)_2$, $LiClF_4$, and mixtures thereof.

b. A polymer fuel which may function both as a plasticizer and a binder, a preferred polymer being a polyphosphonitrilic difluoride.

The polymer has the formula $(NPF_2)_n$, where $n$ is sufficiently high to define a cyclic or linear solid material if the polymer is employed as a binder. When employed as a plasticizer, suitable values of n are about 3 to 9 if the polymer is cyclic.

c. An alkali metal fluoride which functions to sequester any metal fluorides ($BF_3$, $SbF_5$, $PF_5$, etc.) generated during the combustion of the solid grain and thereby prevent their volatization into the laser when the fuel is burned; the use of an alkali metal fluoride is optional. Typical alkali metal fluorides are KF, CsF, $BaF_2$, RbF, $CaF_2$, and mixtures thereof.

d. An augmenting fuel which enhances the energy of combustion; use of an augmenting fuel is optional. Typical fuels include Mg, $Mg_3N_2$, Al, AlN, C, B, Be, etc., and mixtures thereof.

The components in the solid grain fuel preferably have about the following range of weights:

a. Oxidizing salt: 55%-98%;
b. Polymer fuel: 4%-45%;
c. Alkali metal fluoride: 0%-20%; and
d. Augmenting fuel: 0%-10%.

The $(NPF_2)_x$ polymer may be prepared by the method disclosed by:

a. R. A. Shaw, B. W. Fitzsimmons and B. C. Smith, in Chem. Rev. 62, 247(1962); and
b. H. R. Allcock, Chem. Rev. 72, 315(1972).

The solid grain fuels may be produced by blending the powdered ingredients together and then compressing them to their final shape. Generally, the shape of the solid grain may be in the form of solid rods, circular annular rods, star-shaped annular rods, etc.

Alternately, the $(NPF_2)_n$ may be dispersed or dissolved in a fluorocarbon such as a freon to form a solution, dispersion, gel, etc., and the remaining components in powdered form are added. Upon evaporation of the fluorocarbon, a mixture of coated particles is produced. Mild heating and pressure will fuse the particles into a solid grain fuel.

The solid grain fuels may be employed in a device such as disclosed in U.S. Patent 3,863,176 to John S. Martinez et al issued January 28, 1975.

In a typical reaction:

$$\underset{\text{(excess)}}{CsF + NF_4BF_4 + (NPF_2)_n} \xrightarrow{300^\circ F - 800^\circ F} NF_3 + F_2 + N_2 + CsPF_6 + CsBF_4$$

Gaseous $PF_5$ and $BF_3$ are produced and converted to solids by reaction with CsF and remain behind. The $NF_3$, $F_2$ and $N_2$ gases are forwarded to the combustor of the laser for reaction with, for example, hydrogen, benzene or other hydrocarbons to form an excess of free fluorine. Reaction of the free fluorine in the laser cavity forms the lasing species.

If higher temperatures are produced by using more fuel in the composition and/or with an augmenting fuel such as boron, the reaction will produce free fluorine. Typical reaction temperatures required to produce free fluorine from the solid grain fuel exceed about 1200° K.

The solid grain fuels of this invention not only provide a source of fluorine in a stable form for a chemical laser but also permit easier and convenient handling compared to fluorine. Also, no major problems are presented with undesirable byproducts being introduced into the laser. Finally, since the $(NPF_2)_x$ polymer contains no carbon, there is no formation of $CF_4$ as a byproduct; this improves the efficiency of the $NF_3$ and $F_2$ feedstock to the laser.

I claim:

1. A solid grain fuel composition for a chemical laser comprising:

a. an oxidizing salt containing fluorine comprising: $NF_4BF_4$, $NF_4SbF_6$, $N_2F_5AsF_6$, $N_2F_4AsF_5$, $NF_4AsF_6$, $NF_3HBF_4$, $NF_3HClF_3$, $N_2F_4HBF_4$, $N_2F_5BF_4$, $CsSF_5$, $SF_5NF_2$, $KClF_4$, $SF_3BF_4$, $KBrF_4$, $Ba(BrF_4)_2$, $LiClF_4$, and mixtures thereof;

b. a polymer fuel comprising polyphosphonitrilic difluoride;

c. an alkali metal fluoride sequestering agent comprising: KF, CsF, $BaF_2$, RbF, $CaF_2$, and mixtures thereof; and d. an augmenting fuel comprising: Mg, $Mg_3N_2$, Al, AlN, C, B, Be, and mixtures thereof.

2. A solid grain fuel composition for a chemical laser comprising:

a. an oxidizing salt containing fluorine;

b. a polymer fuel comprising polyphosphonitrilic nitrilic difluoride; and, as optional ingredients, a. an alkali metal fluoride sequestering agent; and b. an augmenting fuel.

* * * * *